US011162049B2

(12) United States Patent
Narita

(10) Patent No.: US 11,162,049 B2
(45) Date of Patent: Nov. 2, 2021

(54) LUBRICANT COMPOSITION, MECHANICAL DEVICE INCLUDING LUBRICANT COMPOSITION, AND METHOD OF PRODUCING LUBRICANT COMPOSITION

(71) Applicant: IDEMITSU KOSAN CO., LTD., Chiyoda-ku (JP)

(72) Inventor: Keiichi Narita, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 16/631,666

(22) PCT Filed: Jan. 9, 2019

(86) PCT No.: PCT/JP2019/000264
§ 371 (c)(1),
(2) Date: Jan. 16, 2020

(87) PCT Pub. No.: WO2019/167431
PCT Pub. Date: Sep. 6, 2019

(65) Prior Publication Data

US 2020/0172825 A1 Jun. 4, 2020

(30) Foreign Application Priority Data

Feb. 28, 2018 (JP) ..... JP2018-034476

(51) Int. Cl.

| | |
|---|---|
| ***C10M 141/10*** | (2006.01) |
| ***C10M 133/08*** | (2006.01) |
| ***C10M 135/36*** | (2006.01) |
| ***C10M 137/04*** | (2006.01) |
| *C10N 30/02* | (2006.01) |
| *C10N 30/06* | (2006.01) |
| *C10N 40/08* | (2006.01) |

(52) U.S. Cl.
CPC ..... *C10M 141/10* (2013.01); *C10M 133/08* (2013.01); *C10M 135/36* (2013.01); *C10M 137/04* (2013.01); *C10M 2215/042* (2013.01); *C10M 2219/106* (2013.01); *C10M 2223/04* (2013.01); *C10M 2223/041* (2013.01); *C10N 2030/02* (2013.01); *C10N 2030/06* (2013.01); *C10N 2040/08* (2013.01)

(58) Field of Classification Search
CPC ..... C10M 141/10; C10M 133/08; C10M 135/36; C10M 137/04; C10M 2215/042; C10M 2219/106; C10M 2223/04; C10M 2223/041; C10N 2030/02; C10N 2030/06; C10N 2040/08
See application file for complete search history.

(56) References Cited

U.S. PATENT DOCUMENTS 2,384,146 A * 9/1945 Sharp ..... C10M 1/08 508/334
2012/0277134 A1* 11/2012 Deshimaru ..... C10M 141/10 508/272
2013/0199482 A1* 8/2013 Langston ..... C10M 149/10 123/1 A

FOREIGN PATENT DOCUMENTS

| | | |
|---|---|---|
| JP | 9-235581 A | 9/1997 |
| JP | 10-8081 A | 1/1998 |
| JP | 2009-144045 A | 7/2009 |
| WO | WO 2008/038571 A1 | 4/2008 |
| WO | WO 2011/080970 A1 | 7/2011 |

OTHER PUBLICATIONS

International Search Report dated Mar. 19, 2019 in PCT/JP2019/000264 filed on Jan. 9, 2019, 3 pages.

* cited by examiner

*Primary Examiner* — Cephia D Toomer
(74) *Attorney, Agent, or Firm* — Oblon, McClelland, Maier & Neustadt, L.L.P.

(57) ABSTRACT

Provided is a lubricant composition comprising a lubricant base oil (A), a neutral phosphorus compound (B), an acidic phosphorus compound (C), a sulfur compound (D), and a secondary amine compound (E), and having a flash point of 172° C. or higher.

20 Claims, No Drawings

LUBRICANT COMPOSITION, MECHANICAL DEVICE INCLUDING LUBRICANT COMPOSITION, AND METHOD OF PRODUCING LUBRICANT COMPOSITION

TECHNICAL FIELD

The present invention relates to a lubricating oil composition, a mechanical device including the lubricating oil composition, and a method for producing the lubricating oil composition.

BACKGROUND ART

Recently, carbon dioxide reduction has been strongly desired from the viewpoint of global environmental protection. For this reason, in the field of automobiles, efforts have been concentrated on the development of fuel saving technologies. Examples of fuel-saving automobiles include hybrid cars and electric cars, and it is predicted that these cars will rapidly become popular. Hybrid cars and electric cars are equipped with an electric motor, an electrical generator, an inverter, a storage battery, etc. and run using power of the electric motor.

For cooling electric motors and electrical generators in such hybrid cars and electric cars, existing automatic transmission fluid (hereinafter referred to as ATF) or continuously variable transmission fluid (hereinafter referred to as CVTF) is used. Further, there are hybrid cars and electric cars having a gear speed reducer. For this reason, lubricating oil compositions are required to have both cooling ability and lubricity.

In response to this, a lubricating oil composition obtained by blending a base oil, a neutral phosphorus-based compound, at least one acidic phosphorus-based compound selected from the group consisting of acidic phosphoric acid ester amine salts having a predetermined structure and acidic phosphorous acid esters having a predetermined structure, and a sulfur-based compound has been proposed (Patent Document 1: WO11/080970).

PRIOR ART DOCUMENTS

Patent Documents

Patent Document 1: WO11/080970

SUMMARY OF THE INVENTION

Problems to be Solved by the Invention

However, though the volume resistivity, abrasion resistance between metals and solubility were improved by the lubricating oil composition described in Patent Document 1, it is desired to develop a lubricating oil composition satisfying all of abrasion resistance at a higher level, seizure resistance and low friction properties. Moreover, a lubricating oil composition having higher cooling ability is also desired.

Means for Solving the Problems

In response to this, the present inventors further blended a secondary amine compound in a lubricating oil composition comprising a base oil, a neutral phosphorus-based compound, an acidic phosphorus-based compound and a sulfur-based compound, thereby solving the problems of the present invention.

The present invention includes inventions according to embodiments described below.

[1] A lubricating oil composition comprising a lubricant base oil (A), a neutral phosphorus-based compound (B), an acidic phosphorus-based compound (C), a sulfur-based compound (D) and a secondary amine compound (E), the lubricating oil composition having a flash point of 172° C. or higher.

[2] The lubricating oil composition according to item [1], wherein the secondary amine compound (E) is a compound represented by formula (1):

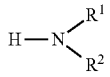

(1)

wherein $R^1$ and $R^2$ each independently represent a substituted or unsubstituted alkyl group having 1 to 18 carbon atoms or a substituted or unsubstituted alkenyl group having 2 to 18 carbon atoms.

[3] The lubricating oil composition according to item [2], wherein $R^1$ and $R^2$ each independently represent a group represented by formula (2):

$$—(CH_2)n—OH \quad (2)$$

wherein n represents an integer of 1 to 8.

A mechanical device including the lubricating oil composition according to any one of items [1] to [3].

A method for producing a lubricating oil composition having a flash point of 172° C. or higher, which includes mixing a lubricant base oil (A), a neutral phosphorus-based compound (B), an acidic phosphorus-based compound (C), a sulfur-based compound (D) and a secondary amine compound (E).

Advantageous Effect of the Invention

In one embodiment of the present invention, the lubricating oil composition exhibits excellent abrasion resistance, seizure resistance and low friction properties. In addition, in one embodiment of the present invention, the lubricating oil composition has excellent cooling performance.

BEST MODE FOR CARRYING OUT THE INVENTION

Hereinafter, embodiments of the present invention will be described in detail. Note that the present invention is not limited to the below-described embodiments and can be arbitrarily changed and then carried out without departing from the gist of the present invention. Note that all the documents and publications cited herein are incorporated herein by reference in their entireties regardless of purposes thereof.

The lubricating oil composition of the present invention comprises a lubricant base oil (A), a neutral phosphorus-based compound (B), an acidic phosphorus-based compound (C), a sulfur-based compound (D) and a secondary amine compound (E). Hereinafter, the respective components contained in the lubricating oil composition will be described in detail.

[Lubricant Base Oil (A)]

The lubricant base oil (A) contained in the lubricating oil composition (hereinafter also referred to as just "base oil") is not particularly limited as long as it is an oil having lubricity, and it can be either a mineral oil or a synthetic oil. The type of the lubricant base oil is not particularly limited, and any material may be suitably selected from among mineral oils and synthetic oils which are conventionally used as a base oil of a lubricating oil for automotive transmissions.

Examples of mineral oils include those obtained by a method in which: a crude oil is subjected to atmospheric distillation to obtain an atmospheric residue; it is subjected to vacuum distillation to obtain a lube-oil distillate; and it is subjected to at least one treatment selected from among solvent deasphalting, solvent extraction, hydrocracking, solvent dewaxing, catalytic dewaxing, hydrotreating, etc. to perform purification. Examples of mineral oils also include those produced by isomerizing a wax or GTL WAX (gas-to-liquid wax). Among them, a mineral oil treated by means of hydrotreating and a mineral oil produced by isomerizing GTL WAX are preferred from the viewpoint of $\%C_P$ and the viscosity index described later.

Examples of synthetic oils include polybutene; poly-α-olefins such as an α-olefin homopolymer and an α-olefin copolymer (e g , ethylene-α-olefin copolymer); esters such as polyol ester, dibasic acid ester and phosphoric acid ester; ethers such as polyphenyl ether; polyglycol; alkylbenzene; and alkylnaphthalene. Among these synthetic oils, poly-α-olefins and esters are preferred. These synthetic oils may be used solely, or two or more of them may be used in combination.

Further, the base oil may contain one mineral oil, or two or more mineral oils. Moreover, in the base oil, one synthetic oil may be used, or two or more synthetic oils may be used in combination. Furthermore, the base oil may contain at least one mineral oil and at least one synthetic oil.

The base oil is the main component of the lubricating oil composition, and usually, the content of the base oil is preferably 65 to 97% by mass, more preferably 70 to 96% by mass, and even more preferably 75 to 95% by mass based on the total amount of the composition.

The flash point of the lubricant base oil (A) is not limited, but when a lubricant base oil having a high flash point is used, a lubricating oil composition obtained tends to also have a high flash point, and therefore it is preferred. Specifically, the flash point of the lubricant base oil (A) is preferably 172° C. or higher, more preferably 174° C. or higher, and particularly preferably 176° C. or higher. When the lubricant base oil (A) contains a plurality of mineral oils, synthetic oils or the like, it is not required that all of the mineral oils, synthetic oils or the like have a flash point of 172° C. or higher, and it is sufficient when the lubricant base oil (A) obtained by mixing the materials has a flash point of 172° C. or higher.

The viscosity of the base oil is not particularly limited and varies depending on intended use of the lubricating oil composition, but the kinetic viscosity at 100° C. is preferably 2 to 30 $mm^2/s$, more preferably 2 to 15 $mm^2/s$, and even more preferably 2 to 10 $mm^2/s$. When the kinetic viscosity at 100° C. is 2 $mm^2/s$ or more, evaporation loss is low, and when it is 30 $mm^2/s$ or less, power loss due to viscous resistance is low and the effect of improving fuel efficiency is obtained.

The kinetic viscosity of the base oil at 40° C. is not particularly limited, but it is preferably 5 to 65 $mm^2/s$, more preferably 8 to 40 $mm^2/s$, and even more preferably 10 to 25 $mm^2/s$. When the kinetic viscosity at 40° C. is 5 $mm^2/s$ or more, evaporation loss is low, and when it is 65 $mm^2/s$ or less, power loss due to viscous resistance is low and the effect of improving fuel efficiency is obtained.

In this specification, "the kinetic viscosity at 100° C." and "the kinetic viscosity at 40° C." can be measured according to the method in accordance with JIS-K-2283:2000. Note that when the lubricant base oil (A) contains two or more oils, "the kinetic viscosity at 100° C." and "the kinetic viscosity at 40° C." mean a kinetic viscosity of the whole mixed base oil.

The viscosity index of the base oil is not particularly limited, but it is preferably 70 or more, more preferably 80 or more, and even more preferably 90 or more. When the viscosity index of the base oil is 70 or more, viscosity change due to temperature change is small. When the viscosity index of the base oil is within the above-described range, it is easy to obtain good viscosity characteristics of the lubricating oil composition, and the effect of improving fuel efficiency is obtained. In the present specification, the "viscosity index" can be measured according to the method in accordance with JIS-K-2283:2000.

The aromatic content ($\%C_A$) and the sulfur content of the base oil according to ring analysis are not particularly limited, but a base oil having $\%C_A$ of 3.0 or less and a sulfur content of 10 mass ppm or less is preferably used. In this regard, $\%C_A$ according to ring analysis represents a ratio (percentage) of an aromatic component measured according to ASTM D 3238 and calculated according to the ring analysis n-d-M method. By using the base oil having $\%C_A$ of 3.0 or less and a sulfur content of 10 mass ppm or less, it is possible to provide a lubricating oil composition which has good oxidation stability and can suppress increase in the acid value and sludge production. $\%C_A$ is more preferably 1.0 or less, and even more preferably 0.5 or less. The sulfur content is more preferably 7 mass ppm or less, and even more preferably 5 mass ppm or less.

The paraffin content ($\%C_P$) of the base oil according to ring analysis is not particularly limited, but it is preferably 70 or more, more preferably 75 or more, and even more preferably 79 or more. When $\%C_P$ is 70 or more, the base oil has good oxidation stability. The upper limit thereof is not particularly limited, but for example, it is 98 or less. In this regard, $\%C_P$ according to ring analysis represents a ratio (percentage) of a paraffin component measured according to ASTM D 3238 and calculated according to the ring analysis n-d-M method.

The NOACK evaporation amount of the base oil is not particularly limited, but it is preferably 15.0% by mass or less, more preferably 14.0% by mass or less, and even more preferably 13.0% by mass or less. The NOACK evaporation amount can be measured according to ASTM D 5800 (250° C., 1 hour).

[Neutral Phosphorus-Based Compound (B)]

The neutral phosphorus-based compound (B) is added for the purpose of improving abrasion resistance between metals. If the neutral phosphorus-based compound (B) is not used, abrasion resistance between metals cannot be improved.

The neutral phosphorus-based compound (B) is not particularly limited as long as it is a neutral compound including a phosphorus atom, but it is preferred to use a compound represented by general formula (3) or (4) below.

(3)

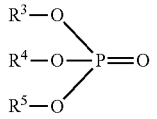

(4)

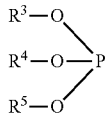

In general formulae (3) and (4) above, $R^3$, $R^4$ and $R^5$ represent, as a hydrocarbon group, an aryl group having 6 to 30 carbon atoms, an alkyl group having 1 to 30 carbon atoms or an alkenyl group having 2 to 30 carbon atoms, preferably an aryl group having 8 to 28 carbon atoms, an alkyl group having 2 to 28 carbon atoms or an alkenyl group having 4 to 28 carbon atoms, more preferably an aryl group having 10 to 26 carbon atoms, an alkyl group having 4 to 26 carbon atoms or an alkenyl group having 6 to 26 carbon atoms, and particularly preferably an aryl group having 12 to 24 carbon atoms, an alkyl group having 6 to 24 carbon atoms or an alkenyl group having 6 to 24 carbon atoms. $R^3$, $R^4$ and $R^5$ may be the same or different.

Examples of the neutral phosphorus-based compound (B) include: aromatic neutral phosphoric acid esters such as tricresyl phosphate, triphenyl phosphate, trixylenyl phosphate, tricresyl phenyl phosphate, tricresyl thiophosphate and triphenyl thiophosphate; aliphatic neutral phosphoric acid esters such as tributyl phosphate, tri-2-ethylhexyl phosphate, tributoxy phosphate and tributyl thiophosphate; aromatic neutral phosphorous acid esters such as triphenyl phosphite, tricresyl phosphite, trisnonyl phenyl phosphite, diphenylmono-2-ethylhexyl phosphite, diphenylmono tridecyl phosphite, tricresyl thiophosphite and triphenyl thiophosphite; and aliphatic neutral phosphorous acid esters such as tributyl phosphite, trioctyl phosphite, trisdecyl phosphite, tristridecyl phosphite, trioleyl phosphite, tributyl thiophosphite and trioctyl thiophosphite. Among these neutral phosphorus-based compounds, aromatic neutral phosphoric acid esters, aliphatic neutral phosphoric acid esters, etc. are preferably used from the viewpoint of abrasion resistance between metals. Further, these neutral phosphorus-based compounds may be used solely, or two or more of them may be used in combination.

The content of the neutral phosphorus-based compound (B) in the lubricating oil composition is preferably 2.5% by mass or less, more preferably 0.12% by mass to 2.5% by mass, and particularly preferably 0.25% by mass to 1.3% by mass based on the total amount of the composition. When the content of the phosphorus-based compound (B) is 0.12% by mass or more based on the total amount of the composition, abrasion resistance between metals in the lubricating oil composition can be further improved. Further, when the content of the neutral phosphorus-based compound (B) is 2.5% by mass or less based on the total amount of the composition, solubility of the neutral phosphorus-based compound (B) in the lubricant base oil can be improved. The amount of phosphorus derived from the neutral phosphorus-based compound (B) is preferably 2000 mass ppm or less, more preferably 100 mass ppm to 2000 mass ppm, and particularly preferably 200 mass ppm to 1000 mass ppm in terms of a phosphorus content based on the total amount of the composition. When the content of the neutral phosphorus-based compound (B) is 2000 mass ppm or less in terms of the phosphorus content based on the total amount of the composition, solubility of the neutral phosphorus-based compound (B) in the lubricant base oil can be improved. When the content of the neutral phosphorus-based compound (B) is 100 mass ppm or more in terms of the phosphorus content based on the total amount of the composition, abrasion resistance between metals in the lubricating oil composition can be further improved. In this regard, the phosphorus content is measured in accordance with JPI-5S-38-92.

[Acidic Phosphorus-Based Compound (C)]

The acidic phosphorus-based compound (C) is added for the purpose of improving seizure resistance. If the acidic phosphorus-based compound (C) is not used, it may be impossible to improve seizure resistance.

The acidic phosphorus-based compound (C) is not particularly limited as long as it is an acidic compound including a phosphorus atom, but it is preferably at least one acidic phosphorus-based compound selected from the group consisting of acidic phosphoric acid esters represented by general formula (5) below and the group consisting of acidic phosphorous acid esters represented by general formula (6) below.

(5)

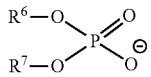

(6)

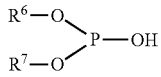

In general formula (5) and general formula (6) above, $R^6$ and $R^7$ represent hydrogen or a hydrocarbon group having 8 to 30 carbon atoms. $R^6$ and $R^7$ may be the same or different. Further, at least one of $R^6$ and $R^7$ is a hydrocarbon group having 8 to 30 carbon atoms, but preferably, both of them is a hydrocarbon group having 8 to 30 carbon atoms, and the carbon number is more preferably 10 to 28, and particularly preferably 12 to 26. When the carbon number of the hydrocarbon group is 8 or more, oxidation stability of the lubricating oil composition is improved, and when the carbon number of the hydrocarbon group is 30 or less, sufficient abrasion resistance between metals is obtained. Examples of the hydrocarbon group in $R^6$ and $R^7$ include an alkyl group, an alkenyl group, an aryl group, an alkylaryl group and an arylalkyl group.

Examples of the acidic phosphoric acid esters represented by general formula (5) and amine salts thereof include: aliphatic acidic phosphoric acid esters such as di-2-ethylhexyl acid phosphate, dilauryl acid phosphate and dioleyl acid phosphate; aromatic acidic phosphoric acid esters such as diphenyl acid phosphate and dicresyl acid phosphate; and sulfur-containing acidic phosphoric acid esters such as S-octyl thioethyl acid phosphate and S-dodecyl thioethyl acid phosphate. These acidic phosphoric acid esters and amine salts thereof may be used solely, or two or more of them may be used in combination.

Examples of the acidic phosphorous acid esters represented by general formula (6) and amine salts thereof include: aliphatic acidic phosphorous acid esters such as dibutyl hydrogen phosphite, di-2-ethylhexyl hydrogen phosphite, dilauryl hydrogen phosphite and dioleyl hydrogen phosphite; aromatic acidic phosphorous acid esters such as diphenyl hydrogen phosphite and dicresyl hydrogen phosphite; and sulfur-containing acidic phosphorous acid esters such as S-octylthioethyl hydrogen phosphite and S-dodecylthioethyl hydrogen phosphite. Further, these acidic phosphorous acid esters may be contained in the lubricating oil composition in the form of an amine salt thereof. These acidic phosphorous acid esters and amine salts thereof may be used solely, or two or more of them may be used in combination.

The content of the acidic phosphorus-based compound (C) in the lubricating oil composition is preferably 0.8% by mass or less, more preferably 0.1% by mass to 0.8% by mass, and particularly preferably 0.1% by mass to 0.5% by mass based on the total amount of the composition. When the content of the acidic phosphorus-based compound (C) is 0.8% by mass or less based on the total amount of the composition, a sufficient volume resistivity of the lubricating oil composition can be obtained. Further, when the content of the acidic phosphorus-based compound (C) is 0.1% by mass or more based on the total amount of the composition, abrasion resistance between metals in the lubricating oil composition can be further improved. The amount of phosphorus derived from the acidic phosphorus-based compound (C) is preferably 400 mass ppm or less, more preferably 50 mass ppm to 400 mass ppm, and particularly preferably 50 mass ppm to 250 mass ppm in terms of a phosphorus content based on the total amount of the composition. When the amount of phosphorus derived from the acidic phosphorus-based compound (C) is 400 mass ppm or less in terms of the phosphorus content based on the total amount of the composition, a sufficient volume resistivity of the lubricating oil composition can be obtained. Further, when the amount of phosphorus derived from the acidic phosphorus-based compound (C) is 50 mass ppm or more in terms of the phosphorus content based on the total amount of the composition, abrasion resistance between metals in the lubricating oil composition can be further improved. In this regard, the phosphorus content is measured in accordance with JPI-5S-38-92.

[Sulfur-Based Compound (D)]

The sulfur-based compound (D) is added for the purpose of improving seizure resistance. If the sulfur-based compound (D) is not used, it may be impossible to improve seizure resistance.

The sulfur-based compound (D) is not particularly limited as long as it is a compound containing a sulfur atom. As the sulfur-based compound (D), publicly-known compounds can be used, and specific examples thereof include a thiadiazole-based compound, a polysulfide-based compound, a thiocarbamate-based compound, a sulfurized fat and oil-based compound and a sulfurized olefin-based compound. Among these sulfur-based compounds, a thiadiazole-based compound and a polysulfide-based compound are preferred from the viewpoint of metal seizure resistance and abrasion resistance between metals. These sulfur-based compounds may be used solely, or two or more of them may be used in combination.

As the thiadiazole-based compound, publicly-known compounds can be suitably used, and examples thereof include a compound represented by general formula (7):

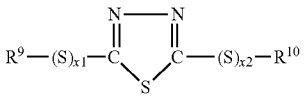

(7)

In general formula (7), $R^9$ and $R^{10}$ each independently represent an alkyl group having 1 to 30 carbon atoms, preferably an alkyl group having 6 to 20 carbon atoms, and more preferably an alkyl group having 8 to 18 carbon atoms. The alkyl group may be either linear or branched. Further, $R^9$ and $R^{10}$ may be the same or different. X1 and X2 each independently represent an integer of 1 to 3 and represent the number of sulfur atoms, but it is preferred to use a compound in which the number of sulfur atoms is 2. As the thiadiazole-based compound represented by general formula (7), preferred are 2,5-bis(n-hexyldithio)-1,3,4-thiadiazole, 2,5 -bis(n-octyldithio)-1,3,4-thiadiazole, 2,5 -bis(n-nonyldithio)-1,3,4-thiadiazole, 2,5-bis(1,1,3,3-tetramethylbutyldithio)-1,3,4-thiadiazole, 3,5-bis(n-hexyldithio)-1,2,4-thiadiazole, 3,6-bis(n-octyldithio)-1,2,4-thiadiazole, 3,5-bis(n-nonyldithio)-1,2,4-thiadiazole, 3,5-bis(1,1,3,3-tetramethylbutyldithio)-1,2,4-thiadiazole, 4,5-bis(n-octyldithio)-1,2,3-thiadiazole, 4,5-bis(n-nonyldithio)-1,2,3-thiadiazole and 4,5-bis(1,1,3,3-tetramethylbutyldithio)-1,2,3-thiadiazole, more preferred are 2,5-bis(n-hexyldithio)-1,3,4-thiadiazole, 2,5-bis(n-octyldithio)-1,3,4-thiadiazole, 2,5-bis(n-nonyldithio)-1,3,4-thiadiazole and 2,5-bis(1,1,3,3-tetramethylbutyldithio)-1,3,4-thiadiazole, and particularly preferred is 2,5-bis(1,1,3,3-tetramethylbutyldithio)-1,3,4-thiadiazole.

As the polysulfide-based compound, publicly-known compounds can be suitably used, and examples thereof include a compound represented by general formula (8):

$$R^{11}—(S)_Y—R^{12} \quad (8)$$

In general formula (8), $R^{11}$ and $R^{12}$ each independently represent an alkyl group having 1 to 24 carbon atoms, an aryl group having 3 to 20 carbon atoms or an alkylaryl group having 7 to 20 carbon atoms, and the alkyl group has preferably 3 to 20 carbon atoms, and more preferably 6 to 16 carbon atoms. The aryl group has preferably 4 to 20 carbon atoms, and more preferably 6 to 16 carbon atoms. The alkylaryl group has preferably 8 to 20 carbon atoms, and more preferably 9 to 18 carbon atoms. $R^{11}$ and $R^{12}$ may be the same or different. Y represents the number of sulfur atoms, and in consideration of abrasion resistance, fatigue life, availability, corrosion, etc., Y is preferably an integer of 2 to 8, more preferably an integer of 2 to 7, and even more preferably an integer of 2 to 6. Examples of groups represented by $R^{11}$ and $R^{12}$ include: aryl groups such as a phenyl group, a naphthyl group, a benzyl group, a tolyl group and a xyl group; and alkyl groups such as a methyl group, an ethyl group, a propyl group, a butyl group, a pentyl group, a hexyl group, a heptyl group, an octyl group, a nonyl group, a decyl group, a dodecyl group, a cyclohexyl group and a cyclooctyl group. These groups may be either linear or branched. Further, these groups may be used solely, or two or more of them may be used in combination. Among the polysulfide-based compounds represented by general formula (6), dibenzyl polysulfide, di-tert-nonyl polysulfide, didodecyl polysulfide, di-tert-butyl polysulfide, dioctyl polysulfide, diphenyl polysulfide, dicyclohexyl polysulfide, etc. are more preferred, and disulfides thereof are particularly preferred.

The content of the sulfur-based compound (D) in the lubricating oil composition is preferably 0.3% by mass or less, more preferably 0.03% by mass to 0.3% by mass, and particularly preferably 0.03% by mass to 0.15% by mass based on the total amount of the composition. When the content of the sulfur-based compound (D) is 0.3% by mass or less based on the total amount of the composition, it can be expected that the volume resistivity of the lubricating oil composition is maintained. When the content of the sulfur-based compound (D) is 0.03% by mass or more based on the total amount of the composition, seizure resistance between metals in the lubricating oil composition can be further improved. The amount of sulfur derived from the sulfur-based compound (D) is preferably 1000 mass ppm or less, more preferably 125 mass ppm to 1000 mass ppm, and from the viewpoint of achieving a balance between the volume resistivity and seizure resistance of the lubricating oil composition, particularly preferably 125 mass ppm to 500 mass ppm in terms of a sulfur content based on the total amount of the composition. When the amount of sulfur derived from the sulfur-based compound (D) is 1000 mass ppm or less in terms of the sulfur content based on the total amount of the composition, it can be expected that the volume resistivity of the lubricating oil composition is maintained. When the amount of sulfur derived from the sulfur-based compound (D) is 125 mass ppm or more in terms of the sulfur content based on the total amount of the composition, seizure resistance between metals in the lubricating oil composition can be further improved. In this regard, the sulfur content is measured in accordance with JIS K 2501.

[Secondary Amine Compound (E)]

The lubricating oil composition is characterized in that it further comprises a secondary amine compound (E) in addition to the lubricant base oil (A), the neutral phosphorus-based compound (B), the acidic phosphorus-based compound (C) and the sulfur-based compound (D). This makes it possible to realize low friction properties of the lubricating oil composition in addition to seizure resistance and abrasion resistance. If the secondary amine compound (E) is not used, it may be impossible to realize low friction properties.

The secondary amine compound (E) contained in the lubricating oil composition is not particularly limited as long as it is a compound having a secondary amine structure. The secondary amine compound (E) preferably has a structure of formula (1). $R^1$ and $R^2$ in formula (1) each independently represent a substituted or unsubstituted alkyl group having 1 to 18 carbon atoms or a substituted or unsubstituted alkenyl group having 2 to 18 carbon atoms, preferably a substituted or unsubstituted alkyl group having 1 to 14 carbon atoms or a substituted or unsubstituted alkenyl group having 2 to 14 carbon atoms, more preferably a substituted or unsubstituted alkyl group having 1 to 8 carbon atoms or a substituted or unsubstituted alkenyl group having 2 to 8 carbon atoms, and particularly preferably a substituted or unsubstituted alkyl group having 1 to 4 carbon atoms or a substituted or unsubstituted alkenyl group having 2 to 4 carbon atoms. The alkyl group and the alkenyl group may be either linear or branched. Examples of substituents which can be possessed by the alkyl group and the alkenyl group include a hydroxyl group, an ester group, a carboxyl group, an amide group, an alkyne group, a trimethylsilyl group, a trimethylsilylethynyl group, an aryl group, an amino group, a phosphonyl group, a thio group, a carbonyl group, a nitro group, a sulfo group, an imino group, a halogeno group, an alkoxy group, a halogen atom (e.g., fluorine, chlorine, bromine and iodine) and a silyl group. Preferred are a hydroxyl group, an ester group, a carboxyl group, an amide group, an aryl group and an amino group, more preferred is a hydroxyl group, and particularly preferred is a hydroxyl group. At least one substituent, and preferably 1 to 4 substituents may be introduced into substitutable positions. When the number of substituents is 2 or more, the substituents may be the same or different from each other.

$R^1$ and $R^2$ in formula (1) are preferably a group represented by formula (2). In formula (2), n represents an integer of 1 to 8, preferably an integer of 1 to 6, and more preferably an integer of 1 to 3.

From the viewpoint of realizing low friction of the lubricating oil composition, the content of the secondary amine compound (E) in the lubricating oil composition is preferably 0.01% by mass to 0.5% by mass, more preferably 0.03% by mass to 0.4% by mass, and particularly preferably 0.07% by mass to 0.3% by mass based on the total amount of the lubricating oil composition.

[Additives]

In the lubricating oil composition, a viscosity index improver, a detergent dispersant, an antioxidant, a metal deactivator, an anti-rust agent, a surfactant/demulsifier, a defoaming agent, a corrosion inhibitor, an oiliness agent, an acid scavenger, etc. can be suitably blended and used to an extent that does not inhibit the effect of the present invention.

Examples of the viscosity index improver include a non-dispersant polymethacrylate, a dispersant polymethacrylate, an olefin-based copolymer, a dispersant olefin-based copolymer and a styrene-based copolymer. Regarding the mass average molecular weight of these viscosity index improvers, for example, the mass average molecular weight of the dispersant and non-dispersant polymethacrylates is preferably 5000 to 300000. The mass average molecular weight of the olefin-based copolymer is preferably 800 to 100000. These viscosity index improvers may be used solely, or two or more of them may be used in combination. The blending amount of the viscosity index improver is not particularly limited, but it is preferably 0.5% by mass to 15% by mass, and more preferably 1% by mass to 10% by mass based on the total amount of the composition.

As the detergent dispersant, an ashless dispersant or a metal-based detergent dispersant can be used.

Examples of the ashless dispersant include a succinimide compound, a boron-based imide compound, a Mannich-based dispersant and an acid amide-based compound. These materials may be used solely, or two or more of them may be used in combination. The blending amount of the ashless dispersant is not particularly limited, but it is preferably 0.1% by mass to 20% by mass based on the total amount of the composition.

Examples of the metal-based detergent dispersant include an alkali metal sulfonate, an alkali metal phenate, an alkali metal salicylate, an alkali metal naphthenate, an alkaline earth metal sulfonate, an alkaline earth metal phenate, an alkaline earth metal salicylate and an alkaline earth metal naphthenate. These materials may be used solely, or two or more of them may be used in combination. The blending amount of the metal-based detergent dispersant is not particularly limited, but it is preferably 0.1% by mass to 10% by mass based on the total amount of the composition.

Examples of the antioxidant include an amine-based antioxidant, a phenol-based antioxidant and a sulfur-based antioxidant. These materials may be used solely, or two or more of them may be used in combination. The blending amount of the antioxidant is not particularly limited, but it is preferably 0.05% by mass to 7% by mass based on the total amount of the composition.

Examples of the pour point depressant include a polymethacrylate, an ethylene-vinylacetate copolymer, a condensate of chlorinated paraffin and naphthalene, a condensate of chlorinated paraffin and phenol, a polyalkyl styrene and a poly(meth)acrylate. The mass average molecular weight (Mw) of the pour point depressant is preferably 20,000 to 100,000, more preferably 30,000 to 80,000, and even more preferably 40,000 to 60,000. Further, the molecular weight distribution (Mw/Mn) is preferably 5 or less, more preferably 3 or less, and even more preferably 2 or less. The content of the pour point depressant may be suitably determined depending on a desired MRV viscosity, etc., and it is preferably 0.01% by mass to 5% by mass, and more preferably 0.02% by mass to 2% by mass based on the total amount of the composition.

Examples of the metal deactivator include a benzotriazole-based metal deactivator, a tolyltriazole-based metal deactivator, a thiadiazole-based metal deactivator and an imidazole-based metal deactivator. These materials may be used solely, or two or more of them may be used in combination. The blending amount of the metal deactivator is not particularly limited, but it is preferably 0.01% by mass to 3% by mass, and more preferably 0.01% by mass to 1% by mass based on the total amount of the composition.

Examples of the anti-rust agent include a petroleum sulfonate, an alkylbenzene sulfonate, a dinonylnaphthalene sulfonate, an alkenyl succinic acid ester and a polyhydric alcohol ester. These materials may be used solely, or two or more of them may be used in combination. The blending amount of the anti-rust agent is not particularly limited, but it is preferably 0.01% by mass to 1% by mass, and more preferably 0.05% by mass to 0.5% by mass based on the total amount of the composition.

Examples of the surfactant/demulsifier include a polyalkylene glycol-based nonionic surfactant. Specific examples thereof include polyoxyethylene alkyl ether, polyoxyethylene alkyl phenyl ether and polyoxyethylene alkyl naphthyl ether. These materials may be used solely, or two or more of them may be used in combination. The blending amount of the surfactant is not particularly limited, but it is preferably 0.01% by mass to 3% by mass, and more preferably 0.01% by mass to 1% by mass based on the total amount of the composition.

Examples of the defoaming agent include fluorosilicone oil and fluoroalkyl ether. These materials may be used solely, or two or more of them may be used in combination. The blending amount of the defoaming agent is not particularly limited, but it is preferably 0.005% by mass to 0.5% by mass, and more preferably 0.01% by mass to 0.2% by mass based on the total amount of the composition.

Examples of the corrosion inhibitor include a benzotriazole-based corrosion inhibitor, a benzimidazole-based corrosion inhibitor, a benzothiazole-based corrosion inhibitor and a thiadiazole-based corrosion inhibitor. These materials may be used solely, or two or more of them may be used in combination. The blending amount of the corrosion inhibitor is not particularly limited, but it is preferably 0.01% by mass to 1% by mass based on the total amount of the composition.

Examples of the oiliness agent include an aliphatic monocarboxylic acid, a polymerized fatty acid, a hydroxyfatty acid, an aliphatic monoalcohol, an aliphatic monoamine, an aliphatic monocarboxylic acid amide, and a partial ester of a polyhydric alcohol and an aliphatic monocarboxylic acid. These materials may be used solely, or two or more of them may be used in combination. The blending amount of the oiliness agent is not particularly limited, but it is preferably 0.01% by mass to 10% by mass based on the total amount of the composition.

As the acid scavenger, an epoxy compound can be used. Specific examples thereof include phenyl glycidyl ether, alkyl glycidyl ether, alkylene glycol glycidyl ether, cyclohexeneoxide, α-olefin oxide and epoxidized soybean oil. These materials may be used solely, or two or more of them may be used in combination. The blending amount of the acid scavenger is not particularly limited, but it is preferably 0.005% by mass to 5% by mass based on the total amount of the composition.

[Characteristics, etc. of Lubricating Oil Composition]

The kinetic viscosity of the lubricating oil composition can be measured by the method in accordance with JIS-K-2283:2000.

From the viewpoint of improving lubricity, viscosity characteristics and fuel-saving performance, the kinetic viscosity of the lubricating oil composition at 100° C. is preferably 14.0 $mm^2/s$ or less, more preferably 12.5 $mm^2/s$ or less, and even more preferably 10.0 $mm^2/s$ or less, while it is preferably 2.0 $mm^2/s$ or more, more preferably 2.2 $mm^2/s$ or more, and even more preferably 2.5 $mm^2/s$ or more.

From the viewpoint of improving lubricity, viscosity characteristics and fuel-saving performance, the kinetic viscosity of the lubricating oil composition at 40° C. is preferably 80.0 $mm^2/s$ or less, more preferably 70.0 $mm^2/s$ or less, and even more preferably 65.0 $mm^2/s$ or less, while it is preferably 5.0 $mm^2/s$ or more, more preferably 7.0 $mm^2/s$ or more, and even more preferably 10.0 $mm^2/s$ or more.

The viscosity index of the lubricating oil composition can be measured by the method in accordance with JIS-K-2283:2000. From the viewpoint of suppressing viscosity change due to temperature change and improving fuel-saving performance, the viscosity index of the lubricating oil composition is preferably 90 or more, more preferably 100 or more, and even more preferably 103 or more.

[Flash Point]

When the flash point of the lubricating oil composition is lower than 172° C., the ability to cool a mechanical device in which the lubricating oil composition is used may be reduced. A high flash point of the lubricating oil composition can be achieved, for example, by using oils having a high flash point for oils constituting the lubricant base oil (A).

The flash point of the lubricating oil composition is 172° C. or higher, preferably 174° C. or higher, and more preferably 176° C. or higher.

[Intended Use of Lubricating Oil Composition]

The above-described lubricating oil composition of the present invention has a flash point within the predetermined range and can exert lubricity (abrasion resistance, seizure resistance, low friction properties). For this reason, the composition can be preferably applied to a mechanical device such as a hydraulic device, a stationary transmission, an automotive transmission and a motor/battery cooling device.

[Method for Producing Lubricating Oil Composition]

The method for producing the lubricating oil composition of the present invention is not particularly limited. The lubricant base oil (A), the neutral phosphorus-based compound (B), the acidic phosphorus-based compound (C), the sulfur-based compound (D) and the secondary amine compound (E) may be blended by any method, and the technique thereof is not limited.

[Mechanical Device]

The lubricating oil composition improves lubricity in a mechanical device and can be used for the mechanical device that is a hydraulic device, a stationary transmission, an automotive transmission or a motor/battery cooling device. For example, the lubricating oil composition can be used for motors mounted on hybrid cars, electric cars, etc., engines mounted on diesel engines or gasoline engines, transmissions of automobiles and the like, etc. In particular, it is preferably used for transmissions mounted on hybrid cars, electric cars, etc.

EXAMPLES

Hereinafter, the present invention will be more specifically described by way of examples. However, the present invention is not limited thereto.

The characteristics and performances in the Examples and Comparative Examples were measured as described below.

(1) Kinetic Viscosity

The kinetic viscosity at 40° C. and the kinetic viscosity at 100° C. were measured using a glass capillary viscometer in accordance with JIS-K-2283:2000.

(2) Viscosity Index

The measurement was carried out by the method in accordance with JIS-K-2283:2000.

(3) Flash Point

The measurement was carried out by the C.O.C. method in accordance with HS-K-2265.

(4) Abrasion Resistance

The abrasion resistance was evaluated by the Shell 4-ball abrasion test. Specifically, the abrasion resistance between metals was evaluated by measuring an abrasion mark diameter under test conditions of a rotation speed of 1800 rpm, a test temperature of 80° C., a load of 392N and a test time of 30 minutes in accordance with the method described in ASTM D4172. The smaller the abrasion mark diameter is, the better the abrasion resistance between metals is.

(5) Seizure Resistance

The weld load (WL) (N) was measured under conditions of a rotation speed of 1800 rpm and room temperature in accordance with ASTM D2783-03 (2014). The larger this value is, the better the seizure resistance is.

(6) Friction Properties

The friction coefficient between metals was measured by the LFW-1 test in accordance with the JASO method (high load method) M358:2005. The smaller this value is, the better the seizure resistance is.

Examples 1-3 and Comparative Examples 1-6

The lubricating oil composition was prepared using the lubricant base oil (A), the neutral phosphorus-based compound (B), the acidic phosphorus-based compound (C), the sulfur-based compound (D), the amine compound, etc. described below according to the composition shown in Table 1. The respective components constituting the lubricating oil composition described in Table 1 are as described below.

[Lubricant Base Oil (A)]

Mineral oil-1: a mineral oil having a kinetic viscosity at 100° C. of 2.4 $mm^2/s$, a viscosity index of 110 and a flash point of 186° C.

Mineral oil-2: a mineral oil having a kinetic viscosity at 100° C. of 2.4 $mm^2/s$, a viscosity index of 105 and a flash point of 176° C.

Mineral oil-3: a mineral oil having a kinetic viscosity at 100° C. of 2.4 $mm^2/s$, a viscosity index of 100 and a flash point of 170° C.

Synthetic oil-1: a synthetic oil having a kinetic viscosity at 100° C. of 2.4 $mm^2/s$, a viscosity index of 110 and a flash point of 186° C.

[Neutral Phosphorus-Based Compound (B)]

Tricresyl phosphate (TCP)

[Acidic Phosphorus-Based Compound (C)]

Dioleyl acid phosphate

[Sulfur-Based Compound (D)]

2,5-bis(1,1,3,3-tetramethylbutyldithio)-1,3,4-thiadiazole

[Secondary Amine Compound (E)]

Diethanolamine ($R^1$ and $R^2$ in formula (1) are a group of formula (2), and n in formula (2) is 2)

[Primary Amine Compound]

Phosphoric acid ester amine salt

Further, the other additives (remaining portion) contained in the compositions of the Examples and Comparative Examples consist of a viscosity index improver, an antioxidant, a detergent dispersant, a pour point depressant, a defoaming agent, etc.

TABLE 1

| | | | Example 1 | Example 2 | Example 3 | Comparative Example 1 | Comparative Example 2 | Comparative Example 3 |
|---|---|---|---|---|---|---|---|---|
| Component composition (% by mass) | Lubricant base oil (A) | Mineral oil-1 | 95.00 | | | | 95.80 | 95.20 |
| | | Mineral oil-2 | | 95.00 | | | | |
| | | Mineral oi1-3 | | | | 95.00 | | |
| | | Synthetic oil-1 | | | 95.00 | | | |
| | Neutral phosphorus-based compound (B) | | 0.80 | 0.80 | 0.80 | 0.80 | | 0.80 |
| | Amount of phosphorus derived from component (B) | mass ppm | 660 | 660 | 660 | 660 | 0 | 660 |
| | Acidic phosphorus-based compound (C) | | 0.20 | 0.20 | 0.20 | 0.20 | 0.20 | |
| | Amount of phosphorus derived from component (C) | mass ppm | 120 | 120 | 120 | 120 | 120 | 0 |
| | Sulfur-based compound (D) | | 0.10 | 0.10 | 0.10 | 0.10 | 0.10 | 0.10 |
| | Amount of sulfur derived from component (D) | mass ppm | 300 | 300 | 300 | 300 | 300 | 300 |

TABLE 1-continued

| | | | | | | | | |
|---|---|---|---|---|---|---|---|---|
| | Secondary amine compound (E) | | 0.10 | 0.10 | 0.10 | 0.10 | 0.10 | 0.10 |
| | Primary amine compound | | | | | | | |
| | Other additives | | Remaining amount | Remaining amount | Remaining amount | Remaining amount | Remaining amount | Remaining amount |
| | Total | | 100 | 100 | 100 | 100 | 100 | 100 |
| Characteristics | Kinetic viscosity at 40° C. | $mm^{2/s}$ | 10.80 | 10.82 | 10.79 | 10.81 | 10.60 | 10.70 |
| | Kinetic viscosity at 100° C. | $mm^2/s$ | 2.85 | 2.83 | 2.85 | 2.82 | 2.81 | 2.82 |
| | Viscosity index | | 111 | 107 | 112 | 105 | 110 | 109 |
| | Flash point | ° C. | 186 | 176 | 188 | 170 | 186 | 188 |
| Performance | Abrasion resistance | mm | 0.44 | 0.45 | 0.43 | 0.46 | 0.65 | 0.48 |
| | Seizure resistance | N | 618 | 618 | 618 | 618 | 618 | 490 |
| | Friction properties | | 0.090 | 0.092 | 0.089 | 0.089 | 0.088 | 0.087 |

| | | | | | | | |
|---|---|---|---|---|---|---|---|
| | | | | Comparative Example 4 | Comparative Example 5 | Comparative Example 6 |
| Component composition (% by mass) | Lubricant base oil (A) | Mineral oil-1 | | 95.10 | 95.10 | 95.00 |
| | | Mineral oil-2 | | | | |
| | | Mineral oi1-3 | | | | |
| | | Synthetic oil-1 | | | | |
| | Neutral phosphorus-based compound (B) | | | 0.80 | 0.80 | 0.80 |
| | Amount of phosphorus derived from component (B) | mass ppm | | 660 | 660 | 660 |
| | Acidic phosphorus-based compound (C) | | | 0.20 | 0.20 | 0.20 |
| | Amount of phosphorus derived from component (C) | mass ppm | | 120 | 120 | 120 |
| | Sulfur-based compound (D) | | | | 0.10 | 0.10 |
| | Amount of sulfur derived from component (D) | mass ppm | | 0 | 300 | 300 |
| | Secondary amine compound (E) | | | 0.10 | | |
| | Primary amine compound | | | | | 0.10 |
| | Other additives | | | Remaining amount | Remaining amount | Remaining amount |
| | Total | | | 100 | 100 | 100 |
| Characteristics | Kinetic viscosity at 40° C. | $mm^{2/s}$ | | 10.72 | 10.74 | 10.73 |
| | Kinetic viscosity at 100° C. | $mm^2/s$ | | 2.82 | 2.82 | 2.82 |
| | Viscosity index | | | 108 | 108 | 109 |
| | Flash point | ° C. | | 186 | 186 | 186 |
| Performance | Abrasion resistance | mm | | 0.48 | 0.48 | 0.48 |
| | Seizure resistance | N | | 490 | 618 | 618 |
| | Friction properties | | | 0.087 | 0.110 | 0.110 |

As shown in Table 1, when Examples 1-3 and Comparative Examples 2-6 were compared to each other, it was found that the lubricating oil composition containing all of the lubricant base oil (A), the neutral phosphorus-based compound (B), the acidic phosphorus-based compound (C), the sulfur-based compound (D) and the secondary amine compound (E) has superior performance with respect to all of abrasion resistance, seizure resistance and friction properties.

Further, when Examples 1-3 and Comparative Examples 5-6 were compared to each other, it was found that when the secondary amine compound (E) is used, friction properties of the lubricating oil composition obtained are improved.

When Examples 1-3 and Comparative Example 1 were compared to each other, it was found that when a base oil having a high flash point is used as the lubricant base oil, the lubricating oil composition obtained has a high flash point. Further, in Examples 1-3, when a base oil having a high flash point was used as the lubricant base oil (A), the flash point of the lubricating oil composition was high, and in particular, in Examples 1 and 3, since the lubricant base oil (A) had a flash point of 186° C. or higher, the flash point of the lubricating oil composition obtained was also high.

The invention claimed is:

1. A lubricating oil composition, comprising:

a lubricant base oil, a neutral phosphorus-based compound, an acidic phosphorus-based compound, a sulfur-based compound, and a secondary amine compound, wherein the lubricating oil composition has a flash point of 172° C. or higher, wherein the acidic phosphorus-based compound is an acidic phosphoric acid ester, and wherein the lubricating oil composition has an abrasion mark diameter of less than 0.48 mm as measured under test conditions of a rotation speed of 1800 rpm, a test temperature of 80° C., a load of 392N and a test time of 30 minutes in accordance with the method described in ASTM D4172.

2. The lubricating oil composition according to claim 1, wherein the secondary amine compound is a compound of formula (1):

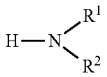

(1)

wherein $R^1$ and $R^2$ each independently represent a substituted or unsubstituted alkyl group having 1 to 18 carbon atoms or a substituted or unsubstituted alkenyl group having 2 to 18 carbon atoms.

3. The lubricating oil composition according to claim 2, wherein $R^1$ and $R^2$ each independently represent a group of formula (2):

$$—(CH_2)n—OH \quad (2)$$

wherein n represents an integer of 1 to 8.

4. The lubricating oil composition according to claim 1, wherein a content of the secondary amine compound is 0.01% by mass to 0.5% by mass based on a total amount of the lubricating oil composition.

5. The lubricating oil composition according to claim 1, wherein the lubricant base oil has a flash point of 172° C. or higher.

6. The lubricating oil composition according to claim 1, which is suitable for a mechanical device.

7. The lubricating oil composition according to claim 6, wherein the mechanical device is a hydraulic device, a stationary transmission, an automotive transmission or a motor/battery cooling device.

8. A mechanical device, comprising:

the lubricating oil composition according to claim 1.

9. The mechanical device according to claim 8, which is a hydraulic device, a stationary transmission, an automotive transmission or a motor/battery cooling device.

10. A method for producing a lubricating oil composition having a flash point of 172° C. or higher, the method comprising:

mixing a lubricant base oil, a neutral phosphorus-based compound, an acidic phosphorus-based compound, a sulfur-based compound and a secondary amine compound, wherein the acidic phosphorus-based compound is an acidic phosphoric acid ester, and wherein the lubricating oil composition has an abrasion mark diameter of less than 0.48 mm as measured under test conditions of a rotation speed of 1800 rpm, a test temperature of 80° C., a load of 392N and a test time of 30 minutes in accordance with the method described in ASTM D4172 .

11. The lubricating oil composition according to claim 1, which consists of the lubricant base oil, the neutral phosphorus-based compound, the acidic phosphorus-based compound, the sulfur-based compound, and the secondary amine compound.

12. The method according to claim 10, wherein the lubricating oil composition consists of the lubricant base oil, the neutral phosphorus-based compound, the acidic phosphorus-based compound, the sulfur-based compound, and the secondary' amine compound.

13. The lubricating oil composition according to claim 1, wherein the acidic phosphoric acid ester is an aliphatic acidic phosphoric acid ester.

14. The lubricating oil composition according to claim 1, wherein, based on a total amount of the composition:

a content of the lubricant base oil is 65 to 97% by mass a content of the neutral phosphorus-based compound is 2.5% by mass or less, a content of the acidic phosphorus-based compound is 0.8% by mass or less, a content of the sulfur-based compound is 0.3% by mass or less, and a content of the secondary amine compound is 0.01% by mass to 0.5% by mass.

15. The lubricating oil composition according to claim 1, wherein the lubricating oil composition has an abrasion mark diameter of 0.43 mm to 0.45 mm as measured under test conditions of a rotation speed of 1800 rpm, a test temperature of 80° C., a load of 392N and a test time of 30 minutes in accordance with the method described in ASTM D4172.

16. The lubricating oil composition according to claim 1, wherein the acidic phosphoric acid ester is an aliphatic acidic phosphoric acid ester, wherein the lubricating oil composition has an abrasion mark diameter of 0.43 mm to 0.45 mm as measured under test conditions of a rotation speed of 1800 rpm, a test temperature of 80° C., a load of 392N and a test time of 30 minutes in accordance with the method described in ASTM D4172, and wherein, based on a total amount of the composition:

a content of the lubricant base oil is 65 to 97% by mass a content of the neutral phosphorus-based compound is 2.5% by mass or less, a content of the acidic phosphorus-based compound is 0.8% by mass or less, a content of the sulfur-based compound is 0.3% by mass or less, and a content of the secondary amine compound is 0.01% by mass to 0.5% by mass.

17. The method according to claim 10, wherein the acidic phosphoric acid ester is an aliphatic acidic phosphoric acid ester.

18. The method according to claim 10, wherein, in the lubricating oil composition and based on a total amount of the composition:

a content of the lubricant base oil is 65 to 97% by mass a content of the neutral phosphorus-based compound is 2.5% by mass or less, a content of the acidic phosphorus-based compound is 0.8% by mass or less, a content of the sulfur-based compound is 0.3% by mass or less, and a content of the secondary amine compound is 0.01% by mass to 0.5% by mass.

19. The method according to claim 10, wherein the lubricating oil composition has an abrasion mark diameter of 0.43 mm to 0.45 mm as measured under test conditions of a rotation speed of 1800 rpm, a test temperature of 80° C., a load of 392N and a test time of 30 minutes in accordance with the method described in ASTM D4172.

20. The method according to claim 10, wherein the acidic phosphoric acid ester is an aliphatic acidic phosphoric acid ester, wherein the lubricating oil composition has an abrasion mark diameter of 0.43 mm to 0.45 mm as measured under test conditions of a rotation speed of 1800 rpm, a test temperature of 80° C., a load of 392N and a test time of 30 minutes in accordance with the method described in ASTM D4172, and wherein, in the lubricating oil composition and based on a total amount of the composition:

a content of the lubricant base oil is 65 to 97% by mass a content of the neutral phosphorus-based compound is 2.5% by mass or less, a content of the acidic phosphorus-based compound is 0.8% by mass or less, a content of the sulfur-based compound is 0.3% by mass or less, and a content of the secondary amine compound is 0.01% by mass to 0.5% by mass.

* * * * *